US009183822B2

(12) United States Patent
MacPherson

(10) Patent No.: US 9,183,822 B2
(45) Date of Patent: Nov. 10, 2015

(54) MUSIC SELECTION AND ADAPTATION FOR EXERCISING

(75) Inventor: Luke David MacPherson, Pyrmont (AU)

(73) Assignee: GOOGLE INC., Mountain View, CA (US)

( * ) Notice: Subject to any disclaimer, the term of this patent is extended or adjusted under 35 U.S.C. 154(b) by 332 days.

(21) Appl. No.: 13/478,671

(22) Filed: May 23, 2012

(65) Prior Publication Data

US 2013/0312589 A1 Nov. 28, 2013

(51) Int. Cl.

| | |
|---|---|
| ***G10H 7/00*** | (2006.01) |
| ***G10H 1/46*** | (2006.01) |
| ***G10H 1/42*** | (2006.01) |

(52) U.S. Cl.

CPC . *G10H 1/46* (2013.01); *G10H 1/42* (2013.01); *G10H 2210/391* (2013.01); *G10H 2220/371* (2013.01); *G10H 2240/131* (2013.01)

(58) Field of Classification Search

USPC ..... 84/612; 482/3–9, 900, 901

See application file for complete search history.

(56) References Cited

U.S. PATENT DOCUMENTS

| | | | | |
|---|---|---|---|---|
| 4,337,529 | A * | 6/1982 | Morokawa | 377/20 |
| 4,788,983 | A * | 12/1988 | Brink et al. | 600/547 |
| 5,215,468 | A * | 6/1993 | Lauffer et al. | 434/236 |
| 5,267,942 | A * | 12/1993 | Saperston | 600/28 |
| 5,592,143 | A * | 1/1997 | Romney et al. | 340/309.16 |
| 6,013,007 | A * | 1/2000 | Root et al. | 482/8 |
| 6,230,047 | B1 * | 5/2001 | McHugh | 600/519 |
| 6,246,362 | B1 * | 6/2001 | Tsubata et al. | 342/357.35 |
| 6,572,511 | B1 * | 6/2003 | Volpe | 482/4 |
| 6,607,493 | B2 * | 8/2003 | Song | 600/502 |
| 6,623,427 | B2 * | 9/2003 | Mandigo | 600/300 |
| 6,808,473 | B2 * | 10/2004 | Hisano et al. | 482/8 |
| 7,003,122 | B2 * | 2/2006 | Chen | 381/67 |
| 7,177,672 | B2 * | 2/2007 | Nissila | 600/519 |
| 7,207,935 | B1 * | 4/2007 | Lipo | 600/28 |
| 7,521,623 | B2 * | 4/2009 | Bowen | 84/612 |
| 7,683,252 | B2 * | 3/2010 | Oliver et al. | 84/612 |
| 7,728,214 | B2 * | 6/2010 | Oliver et al. | 84/612 |
| 7,825,319 | B2 * | 11/2010 | Turner | 84/612 |
| 8,101,843 | B2 * | 1/2012 | Turner | 84/612 |
| 2001/0003542 | A1 * | 6/2001 | Kita | 381/334 |
| 2002/0091049 | A1 * | 7/2002 | Hisano et al. | 482/148 |
| 2002/0091796 | A1 * | 7/2002 | Higginson et al. | 709/218 |
| 2005/0049113 | A1 * | 3/2005 | Yueh et al. | 482/8 |

(Continued)

OTHER PUBLICATIONS

Audio Time-Scale/Pitch Modification, Wikipedia, the free encyclopedia; http://en.wikipedia.org/wiki/Audio_time-scale/pitch_modification, pp. 1-6, Jun. 4, 2015.

(Continued)

*Primary Examiner* — Jeffrey Donels

(74) *Attorney, Agent, or Firm* — Morris & Kamlay LLP

(57) ABSTRACT

Methods, devices, systems, and computer programs are presented for providing music while exercising. One method includes an operation for receiving a request for a music segment from a computing device. The request includes the pace of exercise of a user associated with the computing device. The music segment is selected based on the pace, and the music segment is modified to correlate the tempo of the music segment to the pace of exercise. The modified music segment is sent to the computing device to be played in one or more speakers to provide music that is correlated to the exercise.

19 Claims, 10 Drawing Sheets

(56) References Cited

U.S. PATENT DOCUMENTS

| | | | | |
|---|---|---|---|---|
| 2005/0126370 | A1* | 6/2005 | Takai et al. | 84/636 |
| 2005/0129253 | A1* | 6/2005 | Chen | 381/67 |
| 2005/0141729 | A1* | 6/2005 | Kanzaki et al. | 381/67 |
| 2006/0084551 | A1* | 4/2006 | Volpe, Jr. | 482/8 |
| 2006/0102171 | A1* | 5/2006 | Gavish | 128/95.1 |
| 2006/0107822 | A1* | 5/2006 | Bowen | 84/612 |
| 2006/0111621 | A1* | 5/2006 | Coppi et al. | 600/300 |
| 2006/0169125 | A1* | 8/2006 | Ashkenazi et al. | 84/612 |
| 2006/0243120 | A1* | 11/2006 | Takai et al. | 84/612 |
| 2006/0253210 | A1* | 11/2006 | Rosenberg | 700/94 |
| 2006/0276919 | A1* | 12/2006 | Shirai et al. | 700/94 |
| 2006/0288846 | A1* | 12/2006 | Logan | 84/612 |
| 2007/0027000 | A1* | 2/2007 | Shirai et al. | 482/8 |
| 2007/0044641 | A1* | 3/2007 | McKinney et al. | 84/612 |
| 2007/0060446 | A1* | 3/2007 | Asukai et al. | 482/8 |
| 2007/0074618 | A1* | 4/2007 | Vergo | 84/612 |
| 2007/0074619 | A1* | 4/2007 | Vergo | 84/612 |
| 2007/0079691 | A1* | 4/2007 | Turner | 84/612 |
| 2007/0113725 | A1* | 5/2007 | Oliver et al. | 84/612 |
| 2008/0098876 | A1* | 5/2008 | Kuo et al. | 84/609 |
| 2009/0205482 | A1* | 8/2009 | Shirai et al. | 84/612 |

OTHER PUBLICATIONS

Beat Detection, Wikipedia, the free encyclopedia; http://en.wikipedia.org/wiki/Beat_detection, pp. 1-1, Jun 4, 2015.

Pedometer, Wikipedia, the free encyclopedia; http://en.wikipedia.org/wiki/Pedometer, pp. 1-7, Jun. 4, 2015.

* cited by examiner

MUSIC SELECTION AND ADAPTATION FOR EXERCISING

BACKGROUND

1. Field of the Invention

The present embodiments relate to methods for selecting music, and more particularly, methods, devices, systems, and computer programs for selecting music for exercising.

2. Description of the Related Art

Runners and other athletes often listen to music while exercising. However, when the tempo of the music is different from the rhythm of the exercise, the music may be distracting and interfere with the ability to keep the desired exercise rhythm. The music available to a runner may not always match the desired pace of the runner, causing the runner to lose her rhythm or have a less satisfactory music-listening experience. For example, when the wrong song comes up with a beat or rhythm that is very different from the exercise rhythm, the athlete may wish to change the song to a song with a better tempo. If the runner desires to run at a fast face, the runner would want like to listen to music with a fast pace, to provide motivation for running fast.

In addition, when the wrong song comes up while running, the runner may decide to manually change the song, which sometimes means handling a small music player. This may cause the runner to lose concentration in the run, or sometimes drop the music player, resulting in damage to the music player and an interruption of the run.

Therefore, a system is desired that provides the right music for the right exercise routine. It is in this context that embodiments arise.

SUMMARY

Methods, devices, systems, and computer programs are presented for providing music while exercising. It should be appreciated that the present embodiments can be implemented in numerous ways, such as a method, an apparatus, a system, a device, or a computer program on a computer readable medium. Several embodiments are described below.

In one embodiment, a method includes an operation for receiving a request for a music segment from a computing device, where the request includes a pace of exercise of a user associated with the computing device. The music segment is selected based on the pace, and the music segment is modified to correlate a tempo of the music segment to the pace of exercise. Further, the method includes an operation for sending the modified music segment to the computing device, where operations of the method are executed by a processor.

In another embodiment, a method includes an operation for detecting the pace of exercise of a user, and an operation for selecting a music segment based on the pace. The music segment is modified to correlate the tempo of the music segment to the pace of exercise, and the modified music segment is played in one or more speakers to provide music that is correlated to the exercise. The operations of the method are executed by a processor.

In another embodiment, a method for providing music while exercising includes an operation for detecting a pace of exercise for each section of an exercise program. For each section, a music segment is selected based on the pace of exercise of the section. The method further includes an operation for modifying the music segment to correlate a tempo of the music segment to the pace of exercise of the section. The modified music segment is played in one or more speakers, and operations of the method are executed by a processor In yet another embodiment, a system for providing music while exercising includes a sensor, a processor, and one or more speakers. The sensor is operable to detect a pace of exercise. The processor is operable to select a music segment based on the pace, and to modify the music segment to correlate a tempo of the music segment to the pace of exercise. Additionally, the one or more speakers are operable to play the modified music segment.

Other aspects will become apparent from the following detailed description, taken in conjunction with the accompanying drawings.

BRIEF DESCRIPTION OF THE DRAWINGS

The embodiments may best be understood by reference to the following description taken in conjunction with the accompanying drawings.

DETAILED DESCRIPTION

The following embodiments describe methods, devices, computer programs, and systems to select music for exercising. It will be apparent, that the present embodiments may be practiced without some or all of these specific details. In other instances, well known process operations have not been described in detail in order not to unnecessarily obscure the present embodiments.

Figure 1:
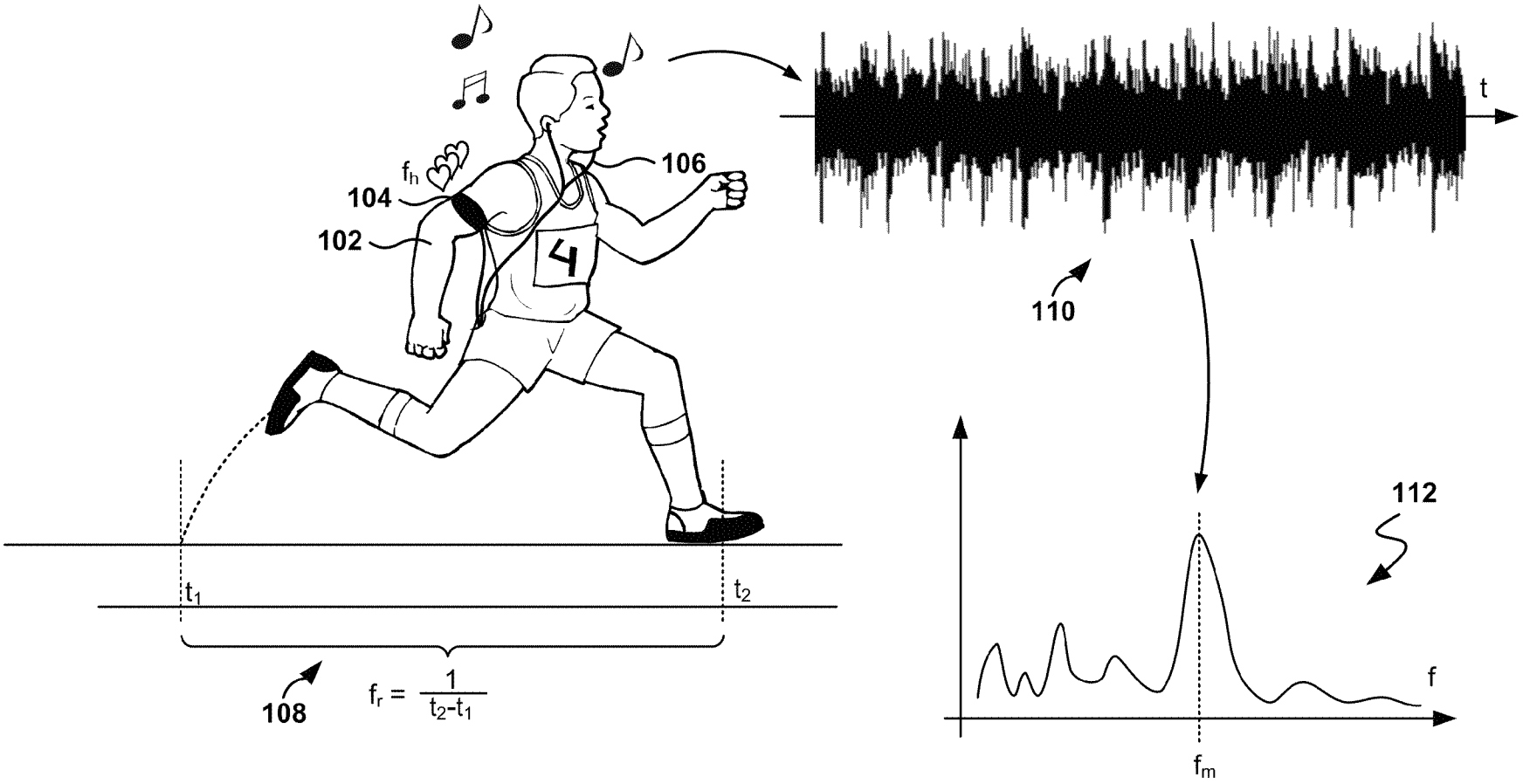
FIG. 1 illustrates a method for selecting music for exercising, according to one embodiment.

FIG. 1 illustrates a method for selecting music for exercising, according to one embodiment. When performing exercises with periodic rhythms it may be desirable to have audio (e.g., a song) synchronized with the cadence of the user. For example, when running, having the beats of a song aligned with foot strikes may make running more enjoyable. Embodiments of the specification provide a method for selecting music for exercising and for modifying the tempo of the music to match the runner's cadence.

It is noted that embodiments below are described with reference the exercise of running, but the embodiments may also be applied to any form of exercise that involves some form of rhythm or cadence, such as biking, rowing, working on an exercise machine, climbing stairs, swimming, etc.

Some embodiments require at least 3 operations: a first operation to detect the cadence of the exercise, a second operation to detect the rhythm in an audio segment, and a third operation to modify the timescale-pitch of the audio segment.

In one embodiment, the detection of the exercise rhythm is performed with a pedometer. As runner 102 runs, a pedometer carried by the runner detects the steps taken by the runner. A pedometer is a device, usually portable and electronic or electromechanical, that counts each step a person takes. Because the distance of each person's step varies, an informal calibration, performed by the user, is required if presentation of the distance covered in a unit of length (such as in kilometers or miles) is desired. Some pedometers include a mechanical sensor and software to count steps. Some advanced step counters rely on Micro-Electro-Mechanical Systems (MEMS) with inertial sensors and software to detect steps. These MEMS sensors may detect acceleration along 1, 2, or 3 axes.

In one embodiment, a pedometer is implemented using an accelerometer to detect changes in the user's body prediction, where upwards acceleration of an accelerometer attached to the user's body (e.g., in a pocket) corresponds to a foot strike.

In some embodiments, the cadence of exercise is detected with other devices such as a bicycle crank, a bicycle wheel sensor, sensors in the user's shoes, sensors in the floor or an exercise pad, an accelerometer, an inertial sensor, an exercise machine sensor, an exercise crank, image analysis of the athlete, etc.

In one embodiment, the frequency of exercise is calculated according to the time used by the runner to take a step, as illustrated in FIG. 1. Therefore, if the runner takes consecutive steps at times $t_1$ and $t_2$, the frequency $f_r$ of exercise is calculated with the following formula 108:

$$f_r = \frac{1}{t_2 - t_1}$$

As used herein, the frequency of the music or the frequency of the exercise refer to the pace, tempo, cadence, or rhythm of the music or the exercise. The frequency is defined by the time elapsed between two moments in time that defined the beginning and end of a cyclical period. For example, when exercising the frequency is defined by the time elapsed between consecutive steps, or consecutive cranks of a bicycle wheel, etc. When referring to music, the frequency is the prevalent beat of the music segment, such as the beat of a drum in the song, although other type of music elements may be utilized to define the prevalent beat or frequency of the song.

Runner 102 listens to music through headphones 106, but other types of speakers may also be utilized, such as standalone speakers, a handheld device in speaker mode, a mobile phone speaker, a Bluetooth speaker, a wireless speaker, etc.

The music played through the headphones has a sound signal 110, which has a frequency spectrum 112 showing that the music has a predominant frequency $f_m$, which is an indicator of the tempo of the song. Embodiments described below detail how to select music that has a frequency $f_m$ (e.g., rhythm) that matches the frequency of the exercise $f_r$.

In one embodiment, the heart rate of the athlete is measured via a sensor, such as a bracelet sensor 104 that detects the heartbeat of the athlete. The heart rate of the athlete may also be utilized to select songs based on the heart rate, in order to motivate the athlete to slow down or speed up the pace.

Figure 2A:
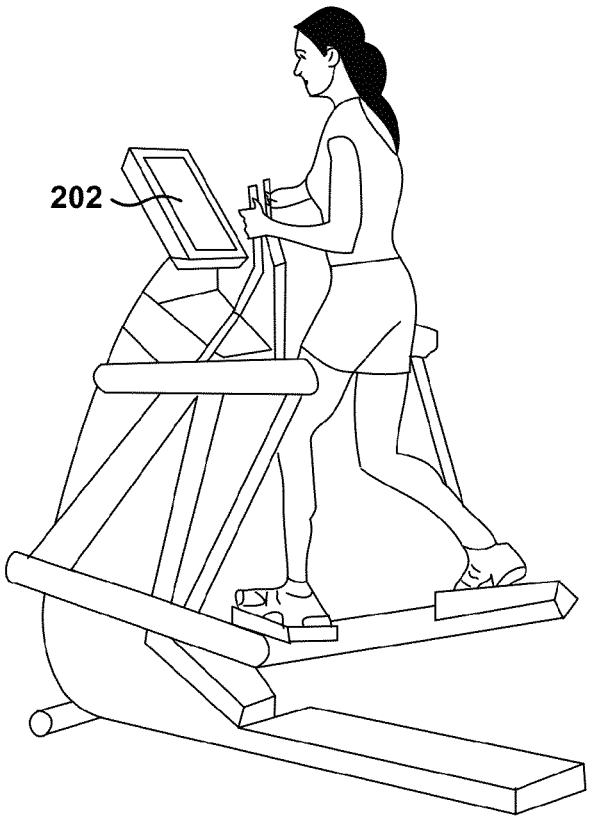
FIG. 2A illustrates a user working out on an exercise machine that supplies music based on the exercise, according to one embodiment.

FIG. 2A illustrates a user working out on an exercise machine that supplies music based on the exercise, according to one embodiment. With an exercise machine, it is relatively easy to detect the pace of the exercise, as most machines have a natural cycle when operated, such as the cycle of the pedals, or the cycles of the rowing back and forth in a rowing machine, etc.

In addition, exercise machines may have sensors to detect the vital signs of the athlete. For example, some exercise machines include heart rate monitors (e.g., in the handlebar) to detect the heart rate. Further, exercise machines often provide different exercise programs based on the age of the person, the weight, the duration of the exercise, the difficulty level, etc.

Some of the programs vary the resistance level provided during the exercise, alternating periods with low, medium or high levels of effort required. In one embodiment, the music selected changes according to the level required for each section of the program. For one embodiment, an a first operation, the pace of exercise is detected for each section of the exercise program. For each section, a music segment is selected based on the pace of exercise of the section, and the music segment is modified to correlate the tempo of the music segment to the pace of exercise in the corresponding section. The modified music segment is then played in one or more speakers.

In one embodiment, the music selection for each exercise program is predefined in advance (e.g., at the factory) in order to select music that matches the exercise program. In one embodiment, each section of the program is associated with a prevalent beat or rhythm, and then an appropriate song is selected, and sometimes altered, for that segment. The appropriate song has a prevalent tempo that matches the beat of the exercise.

In some embodiments, a user interface is provided in order to select the adequate music, where for each segment of the exercise program, a selection of candidate songs is presented to the user configuring the music for the exercise program. The candidate songs have a prevalent tempo that is equal to the desired rhythm of the exercise program, or is within a predetermined threshold of difference (e.g. two percent, although other values are also possible). In one embodiment, the threshold difference is 10 percent.

The person configuring the exercise program selects song for each of the segments, and when all the songs are selected, the exercise program is configured with the desired music.

In another embodiment, the music selection is done "on the fly," which means that the song is selected according to the desired phase at a particular point in time during a program exercise. As discussed above, the intensity of the exercise program may depend on several factors, such as age, weight, resistance level, etc. An additional factor may include the difference between the desired exercise pace and the actual pace being delivered by the athlete. If the athlete "falls behind" the system may provide a music selection that has a faster beat than the current pace of exercise, in order to motivate the athlete to go faster. Conversely, if the athlete is going too fast, the system may provide a slower song to encourage the athlete to slow down.

A display 202 is provided in the exercise machine to select different exercise options, including the type of music desired and if the music should match the exercise program.

Figure 2B:
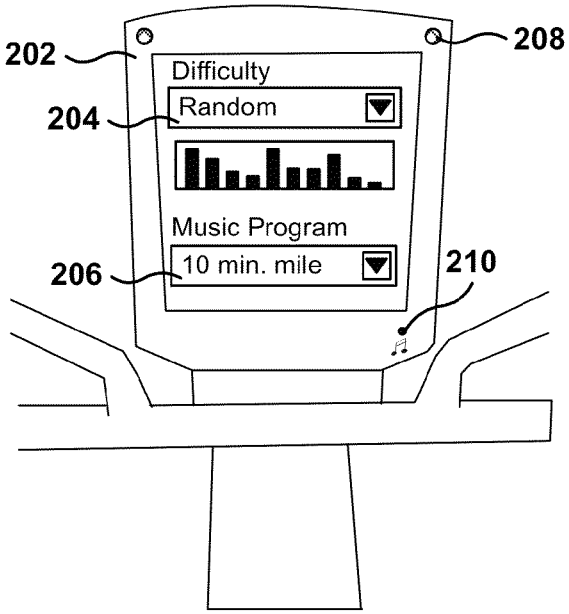
FIG. 2B illustrates a user interface for the exercise machine of FIG. 2A, according to one embodiment.

FIG. 2B illustrates a user interface for the exercise machine of FIG. 2A, according to one embodiment. The simplified user interface 202 includes an option for selecting a program or a difficulty level 204 in an exercise machine, and an option to select a music program 206 (e.g., a music program the sets of pace targeted to run a 10 minute mile).

A connector 210 makes music available via headphones, and speakers 208 may also be utilized to provide music. It is noted that the embodiment illustrated in FIG. 2B is exemplary. Other embodiments may utilize different arrangement of fields, may include additional fields, screens, menus, etc. The embodiment illustrated in FIG. 2B should therefore not be interpreted to be exclusive or limiting, but rather exemplary or illustrative.

In one embodiment, the music is selected based on the heart rate of the athlete. The desired heart rate for the athlete is calculated based on the characteristics of the athlete (e.g., age, sex, weight) and based on the exercise program. During the exercise program, the desired heart rate may vary depending on the exercise. For example, the desired heart rate may be slower at the beginning of the exercise and increase over time as the athlete warms up. Also, there may be periods of peak intensity that are more demanding, and periods with less intensity that are less demanding.

As the heartbeat of the athlete is monitored, the system determines if the heart rate is at the desired rate, or if the heart rate is higher or lower. Based on the difference between the actual heart rate and the desired heart rate, the system selects a song with a fast or slow pace in order to encourage the athlete to go faster, slower, or maintain the same effort level.

Figure 3A:
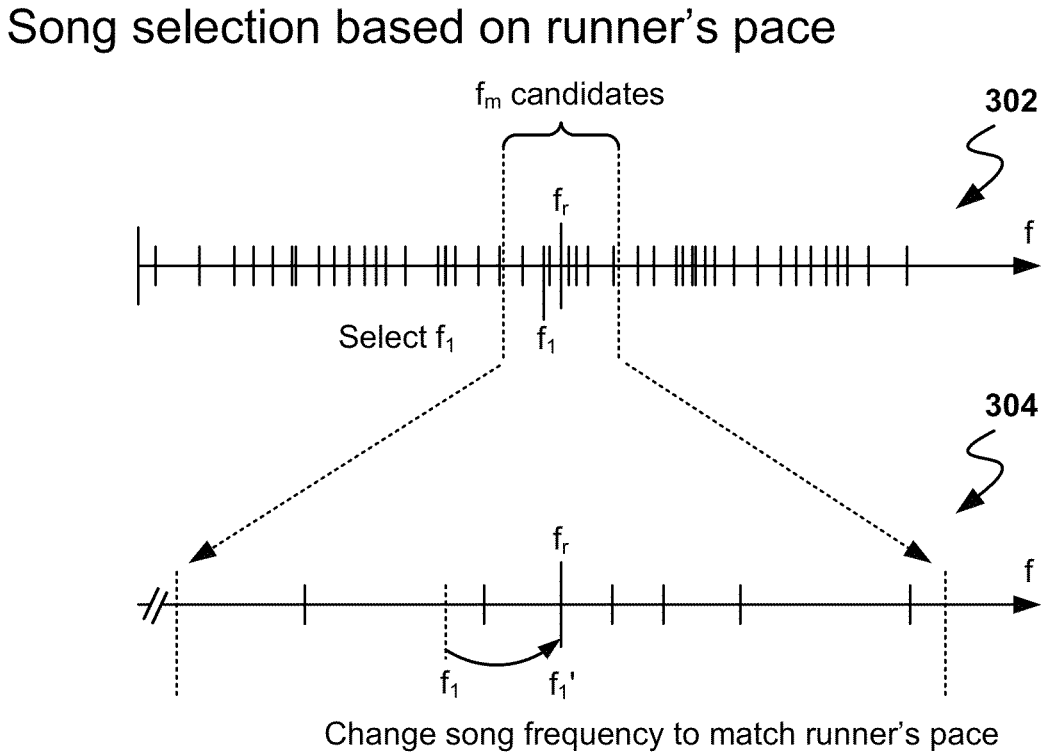
FIG. 3A shows a frequency spectrum analysis for selecting music, according to one embodiment.

FIG. 3A shows a frequency spectrum analysis for selecting music, according to one embodiment. In signal analysis, beat detection utilizes a computing device to detect the beat of a musical score. There are several methods to detect the beat of a music score. Beat detectors are common in music visualization software such as some media player plugins. The methods utilized may be based on statistical models regarding sound energy or may involve sophisticated comb filter networks or some other means.

In one embodiment, each song of a music library is analyzed to detect the prevailing beat for the music score. In some embodiments, a song may be associated with more than one beat, such as a large music score with several distinct phases. For simplicity purposes, embodiments described herein are for songs with a single prevailing beat, but other embodiments may utilize songs with multiple beats, and the proper section of the song may be utilized as needed to match a desire exercise pace. In one embodiment, a song with multiple sections with different beats may be synchronized with the program exercise that utilizes different intensity levels during the different sections of the song.

In one exemplary embodiment, the different frequencies of the songs in the music library are plotted in a frequency scale 302. When selecting music for a running or exercise pace with a frequency $f_r$, potential music candidates are selected from within a frequency range $f_m$ around the frequency $f_r$. In one embodiment, the upper and lower boundaries of the range are calculated as being equal to $f_r$ plus or minus 5 percent of $f_r$, but other ranges are also possible. Therefore, the lower frequency boundary is equal to ($f_r$+0.05 $f_r$), or 0.95 $f_r$, and the upper frequency boundary is equal to ($f_r$+0.05 $f_r$), or 1.05 $f_r$. The songs within the range are similar in cadence to the exercise pace, but may not be exactly equal to the exercise pace. In one embodiment, a selected song is modified in order to match the desired exercise pace.

When a song within the range is selected having a frequency of $f_1$, the song is modified in order to have a modified song with the new beat frequency equal to the desired $f_r$, which is the song played for the athlete. Frequency chart 304 provides an expanded view of the range for the candidates. The selected song is modified to have a new frequency $f_1'$, which is equal to $f_r$. Dividing the desired frequency of the song (e.g., the frequency of the exercise) $f_r$ by the actual frequency of the song $f_1$, then the result is the ratio of adjustment required r.

$$r = \frac{f_r}{f_1}$$

Time stretching is the process of changing the speed or duration of an audio signal without affecting the pitch. This process is used, for instance, to match the pitches and tempos of two pre-recorded clips for mixing when the clips cannot be re-performed or resampled. It may also be used to create effects such as increasing the range of an instrument (like pitch shifting a guitar down an octave).

One way to change the duration or pitch of a digital audio clip is to resample the audio clip. This is a mathematical operation that effectively rebuilds a continuous waveform from its samples and then samples that waveform again at a different rate. When the new samples are played at the original sampling frequency, the audio clip sounds faster or slower. Unfortunately, the frequencies in the sample are always scaled at the same rate as the speed, transposing its perceived pitch up or down in the process. In other words, slowing down the recording lowers the pitch, speeding up the recording raises the pitch, and the two effects cannot be separated. This is analogous to speeding up or slowing down an analogue recording, like a phonograph record or tape, creating the chipmunk effect.

There several known methods to change the duration, which means changing the rhythm, of a recording without affecting the pitch, such as Phase Vocoder, Time Domain Harmonic Scaling, Sinusoidal/Spectral Modeling, etc.

In one embodiment, the rhythm of the song may be altered slightly during the playback of the song, as the exercise pace of the athlete may change over time. For example, a runner may decrease the pace by five percent and the song will also be decreased in rhythm by five percent. However, in one embodiment, there is a frequency threshold for changing of the song (e.g., 10 percent) in order to avoid too much distortion that would be noticeable by a person. In this case, the song may continue to be played until finished even though the song may not exactly match the current pace of the athlete.

In one embodiment, the frequency of the candidate songs may be a multiple of the exercise frequency $f_r$, or the exercise frequency $f_r$ may be a multiple of the frequency of the candidate song. In addition, there may be other integer ratios between the frequencies, such as 2:1, 3:1, 3:2, etc., as long as the beat of the exercise (e.g., a foot touching the ground) coincides every few cycles with the beat of the music. Of course, there may be an initial adjustment of the phase of the audio, as described below with reference to FIG. 3B.

Figure 3B:
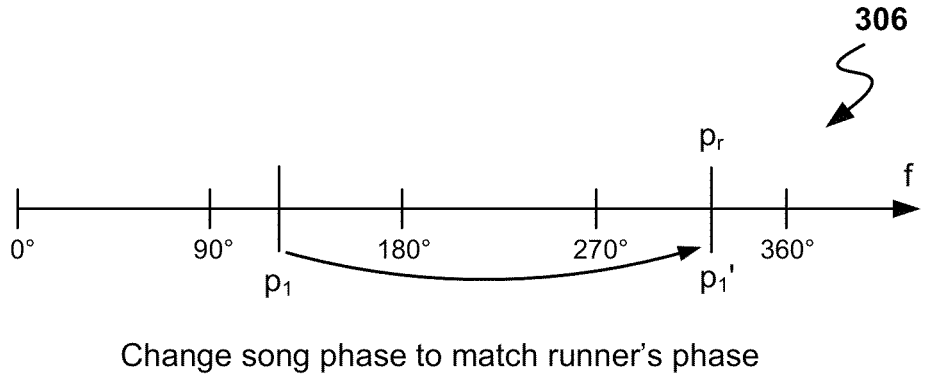
FIG. 3B illustrates a method for adjusting the phase of the music signal, according to one embodiment.

FIG. 3B illustrates a method for adjusting the phase of the music signal, according to one embodiment. Because the user's movement has to be synchronized with the audio, it may be necessary to introduce a delay into the audio signal to match up the beats with the movement. The time delay between the two signals is measured and the difference is added (or subtracted) from the audio signal to make the two signals beat at the same time.

The delay may be introduced in increments, that is, a small delay is introduced in each cycle of the song, in order to minimize the apparent distortion the song. The amount of audio delay introduced in any cycle should be limited to an amount that is not disruptive to the user. As a result, the user motion appears to be synchronized with the audio beats.

FIG. 3B illustrates how the phase of the song $p_1$ is changed to a new phase $p_1'$ to make the phase of the song coincide with the phase of the exercise $p_r$. In one embodiment, the phase change is obtained by adding a delay to the audio.

Figure 4:
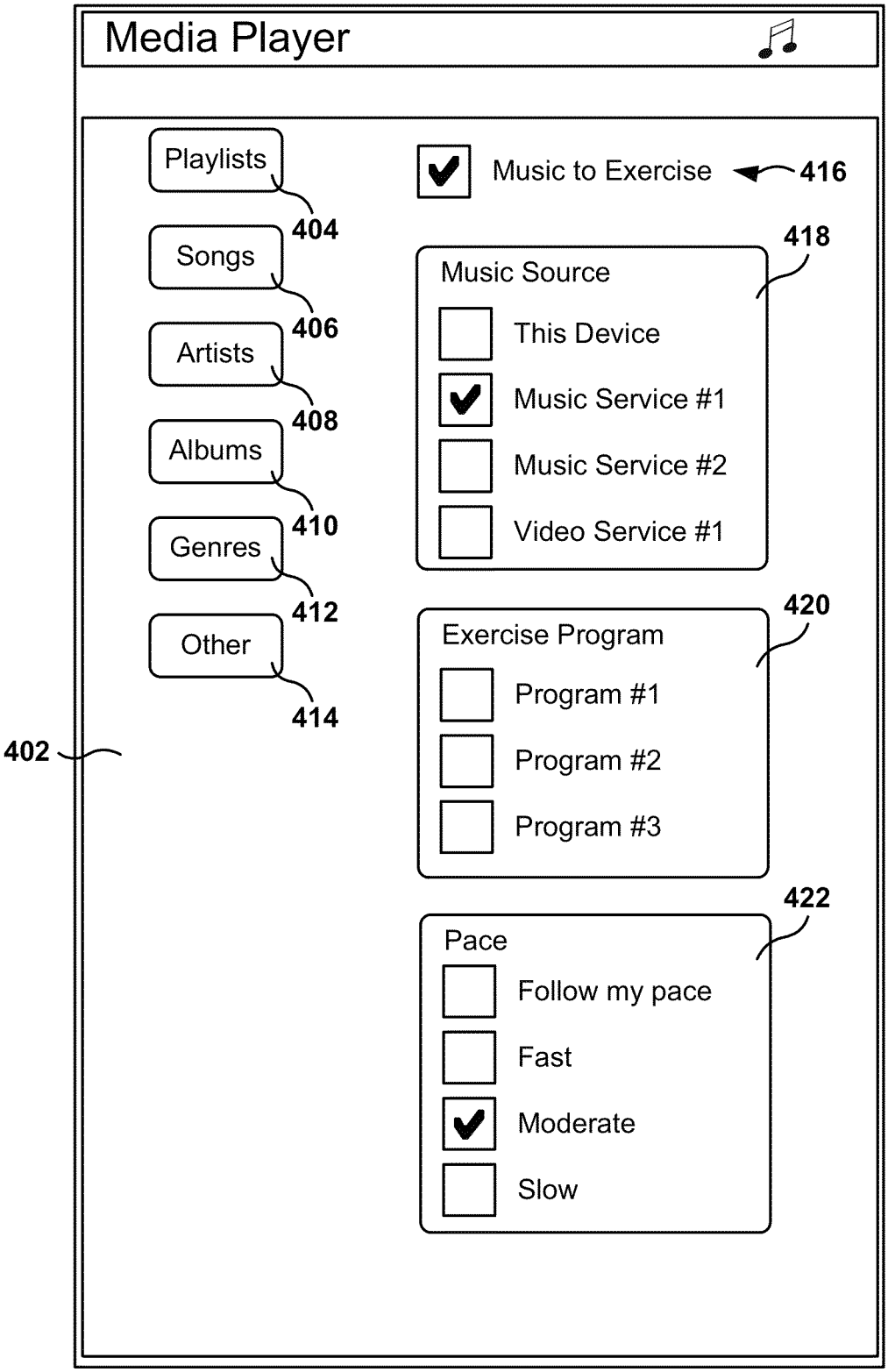
FIG. 4 is a sample Graphical User Interface (GUI) of a computing device operable to provide music for exercising, according to one embodiment.

FIG. 4 is a sample Graphical User Interface (GUI) of a computing device operable to provide music for exercising, according to one embodiment. The GUI 402 may be part of an exercise machine (e.g., a treadmill), or may be part of a computing device such as a music player, a video player, a mobile phone, etc.

The GUI 402 includes typical options for music selection, such as selecting a playlist 404, selecting a song 406, selecting an artist 408, selecting an album from the music library 410, selecting a genre 412, and an "Other" option that opens a separate menu which further options for selecting music or configuring the computing device.

The GUI 402 further includes a toggle option to select or deselect whether to have music correlated to the exercise 416. When this option to select music for exercising 416 is selected, the computing device selects music that is correlated with the exercise, and modifies the music, if needed, as described above with reference to FIGS. 1-3B.

Option 418 allows the user to select the source of the music, which may include the music library in a computing device, a music service that provides music over the Internet, a video service that provides videos with music, etc. When selecting the option to exercise with synchronized music, the music source selected must be able to provide music for a desired pace of exercise. In other words, the music service must have computer interface that receives the frequency of exercise as an input (or the desired frequency of exercise) and provides an audio segment that matches, or that is close, to the input frequency. In one embodiment, the computer interface also provides the beat of the song (e.g., the frequency of the song), so the computing device that plays the music is able to alter the music slightly, as described above, to synchronize music with exercise.

Option 420 enables the user to select a predefined exercise and music program. A predefined exercise and music program is a program which includes instructions for exercising (e.g., effort level, duration, etc.) as well as the music that accompanies the exercise instructions.

Option 422 enables the user to select music based on the current pace of exercise. In one embodiment, the options include following the current pace of exercise, fast, moderate (or medium), and slow, but other options are also possible, for example, a numerical scale may be provided to select the pace (e.g., 1 to 10). When the user selects the "follow my pace" option, the music adjusts to the rhythm of the athlete, that is, if the exercise is fast-paced the music will be fast-paced, and if the exercise is slow-paced the music will be slow-paced. When the option is to select fast music, the computer program selects music with a fast pace to encourage the user to exercise at a fast pace.

It is noted that the embodiments illustrated in FIG. 4 are exemplary. Other embodiments may utilize different fields, fewer fields, additional fields, or arrange the fields in a different layout. The embodiments illustrated in FIG. 4 should therefore not be interpreted to be exclusive or limiting, but rather exemplary or illustrative.

Figure 5A:
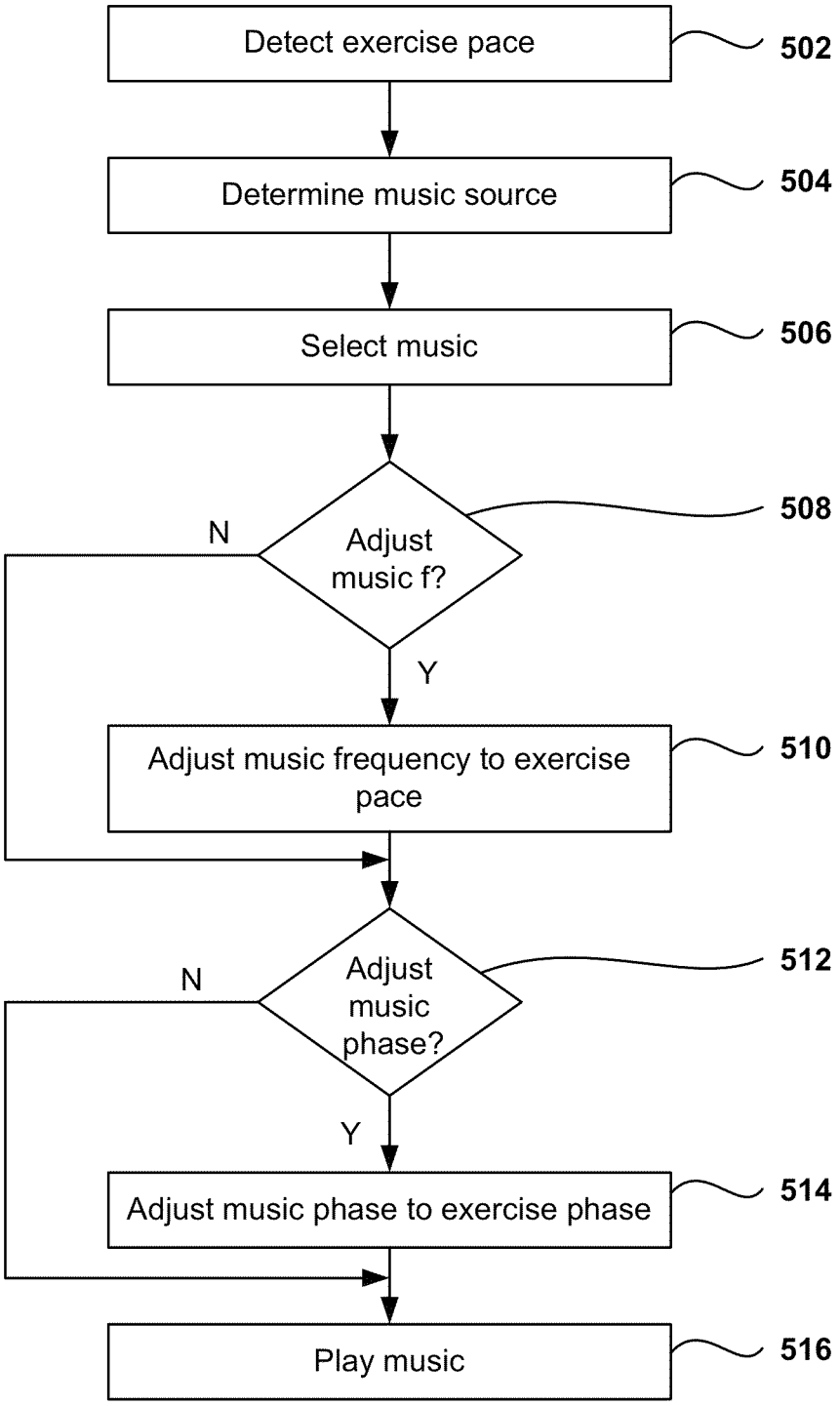
FIGS. 5A-5B include flowcharts of methods for selecting and modifying music to match the music with the pace of an exercise routine, according to one embodiment.

FIG. 5A is a flowchart of a method for selecting and modifying music to match the music with the pace of an exercise routine, according to one embodiment. In operation 502, the pace of exercise is detected by utilizing a pedometer or some other sensor but that is to the athlete or to a machine being operated by the athlete.

From operation 502 the method flows to operation 504 where a music source is determined. The music may be retrieved from a music library, such as the one stored in a portable computer device, or may be retrieved from another source available over a network connection (e.g., Internet radio, Internet music service, video service, etc.).

In operation 506, a music piece is selected. In one embodiment, the music piece selected has a rhythm that matches, or closely matches, the exercise pace. From operation 506 the method flows to operation 508 where a check is performed to determine if the selected music piece needs to be adjusted in order to make the beat or rhythm of the music to be closer to the exercise pace. See for example the description above with reference to FIG. 3A regarding the adjustment of the music to correlate the music with the exercise.

If the music needs to be adjusted, the method flows to operation 510 where the music is modified in order to change the pace of the music without creating a pitch distortion. If the music segment does not need to be adjusted, the method flows to operation 512, where another check is made to determine if the music is out of phase with the exercise. In other words, to determine if the beat of the music and the beat of the exercise occur at the same time.

If the phase of the music needs to be adjusted the method flows to operation 514, where the music is adjusted to correlate the music with the exercise (see for example the description above with reference to FIG. 3B). In order to adjust the phase of the music, a delay is introduced to make the music and the exercise beat at the same time. From operation 514 the method flows to operation 516 were the music is played through one or more speakers.

Figure 5B:
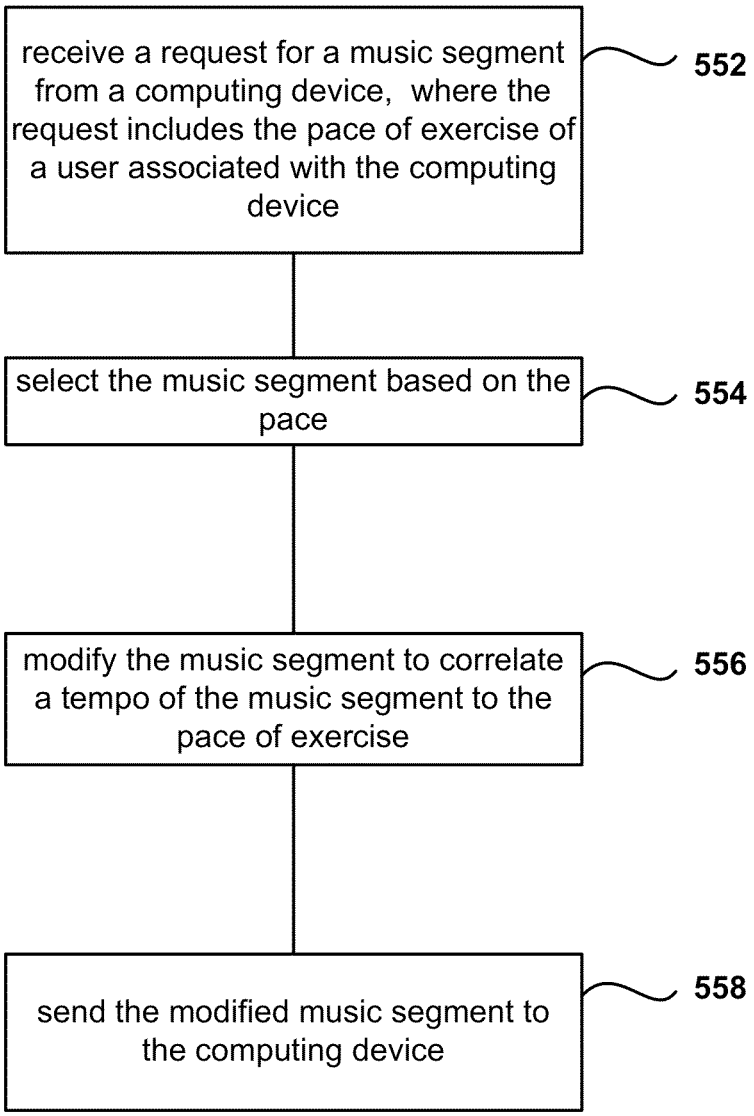

FIG. 5B includes a flowchart for a method where the music selection and the modification of the music is performed at a server. The computing device playing the music for the athlete includes network capabilities, and the computing device selects a server as the music source and sends a request to the server for music.

In operation 852, the server receives a request for a music segment from the computing device, where the request includes the pace of exercise of a user associated with the computing device. In response, the server selects a music segment based on the pace in operation 854. In one embodiment, the request further includes information about the phase of the exercise, that is, the place in time where the beat of the exercise is taking place.

In general, servers have a bigger library of music that may be used for selecting music for exercising according to the pace. In addition, a server will have higher computing resources, if modifications to the music are to be performed.

After receiving the request from the computing device, the server selects a music segment based on the pace of the exercise identified in the request for music. If the selected music does not exactly match the pace of exercise, the server modifies the music segment in operation 856, as described above, in order to match the frequency of the music with the frequency or pace of the exercise.

In operation 558, the server sends a response to the request that includes the music segment, which may have been modified to match the pace. In one embodiment, the response includes pace information of the music, in order to identify where the beat of the song is taking place. This way, the computing device (e.g., a music player) is able to synchronize the rhythm of the exercise with the beats of the song, as described above with reference to FIG. 3B.

In another embodiment, the communication delay between sending the request and receiving the music is small enough, that the phase adjustment of the music is performed by the server, allowing the music player to just play the music received, without having to perform computer operations to match the beat of the exercise with the beat of the song.

In one embodiment, the phase of the exercise may not be very significant when the exercise follows a continuous pattern. For example, riding a bicycle is a continuous exercise and synchronizing the music with the exercise may not require placing the beat of the music at a particular place in time with reference to the exercise.

Figure 6:
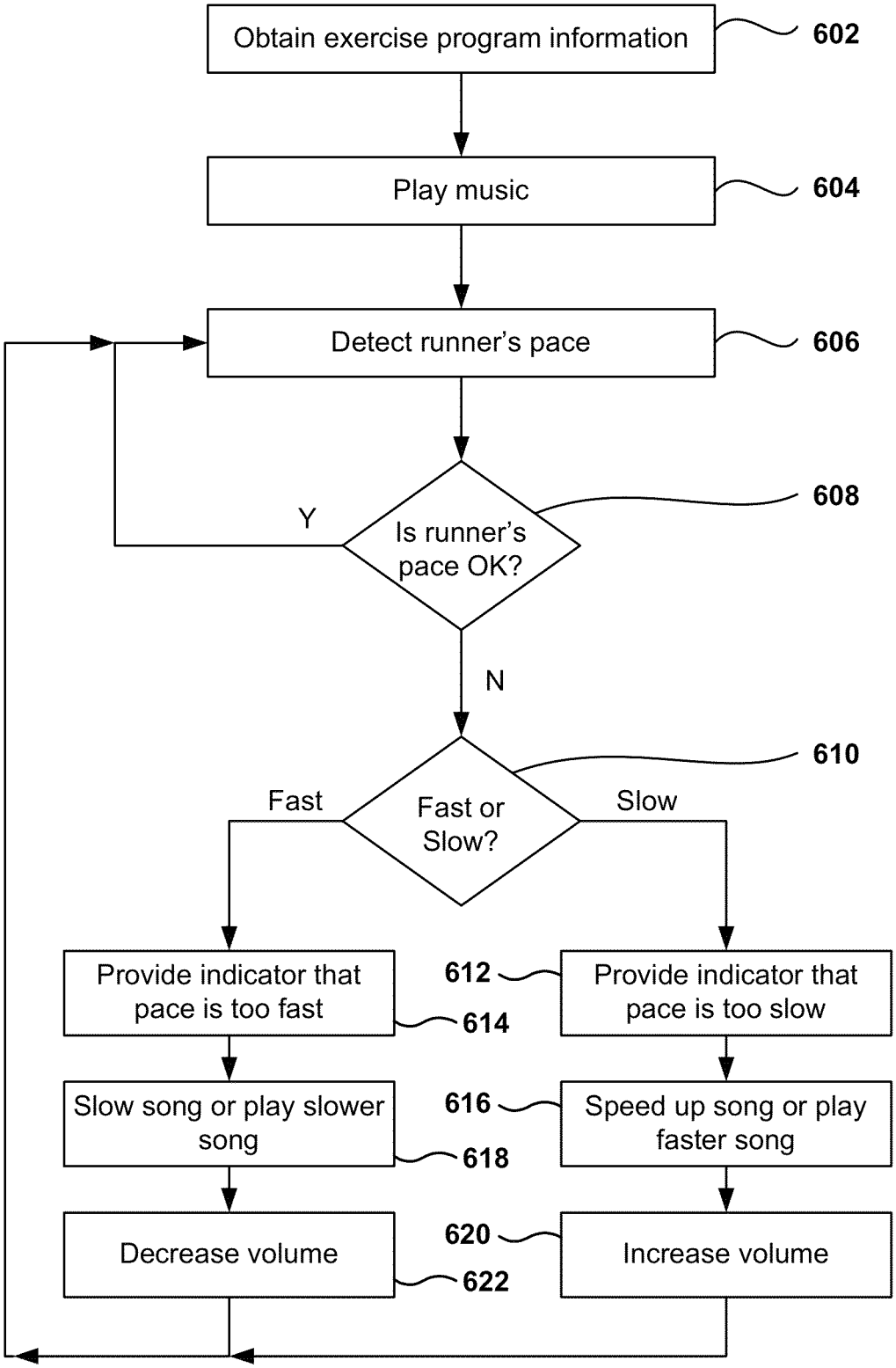
FIG. 6 is a flowchart of a method for providing music to encourage a person exercising to adjust the pace of exercise, according to one embodiment.

FIG. 6 is a flowchart of a method for providing music to encourage a person exercising to adjust the pace of exercise, according to one embodiment. In operation 602, exercise program information is obtained. In one embodiment, the program information includes one or more of segments within the program, duration of each segment, difficulty level of each segment, default audio for the segment, optimal pace for the segment, the desired heart rate for the segment (which might be based on different factors such as age, weight, difficulty, etc.), or sound level for each segment.

From operation 602 the method flows to operation 604 where the selected music is played for the corresponding segment of the exercise program. In operation 606, the pace of the runner is detected and in operation 608 a check is performed to determine if the pace of the runner is the desired pace for that segment, as dictated by the exercise program.

If the pace is appropriate, the method flows back to operation 606 to continue checking the pace of the runner. Of course, if the exercise program ends (not shown) then the method will end. However, if the pace of the runner is not in line with the desired pace of the exercise program, a check is performed in operation 610 to determine if the pace of exercise is too fast or too slow.

If the pace is too fast, an indicator (e.g., a message on a display, a warning light, etc.) is provided in operation 614 to alert the user that the pace is too fast. In addition, the music being played is slowed down slightly (e.g., without presenting distortion that would be noticeable by the user), or a song with a slower pace is selected, in operation 618. Further, in one embodiment, the volume is decreased to discourage the user from continuing the fast pace, in optional operation 622.

If the pace is too slow, an indicator (e.g., a message on a display, a warning light, etc.) is provided in operation 612 to alert the user that the pace is too slow. In addition, the music being played is accelerated slightly (e.g., without presenting distortion that would be noticeable by the user), or a song with a faster pace is selected, in operation 616. Further, in one embodiment, the volume is increased to encourage the user to increase the pace, in optional operation 622.

Therefore, in one embodiment, to motivate a person exercising to increase the pace, the music segment having a faster tempo than the pace of exercise is selected, and to motivate the person exercising to decrease the pace, the music segment having a slower tempo than the pace of exercise is selected. From operations 620 and 622 the method flows back to operation 606 to continue checking for the athlete's pace.

In another embodiment, the volume is controlled according to the configuration for each of the segments of the program exercise. When the person is in the peak of the run, (e.g., interval training) the volume is increased, and when a person is in the slower part or the run the music is played softer. When there is a transition to a more intense part of the run, then the volume increases. Sound control helps the person to get motivated to give an extra effort.

Figure 7:
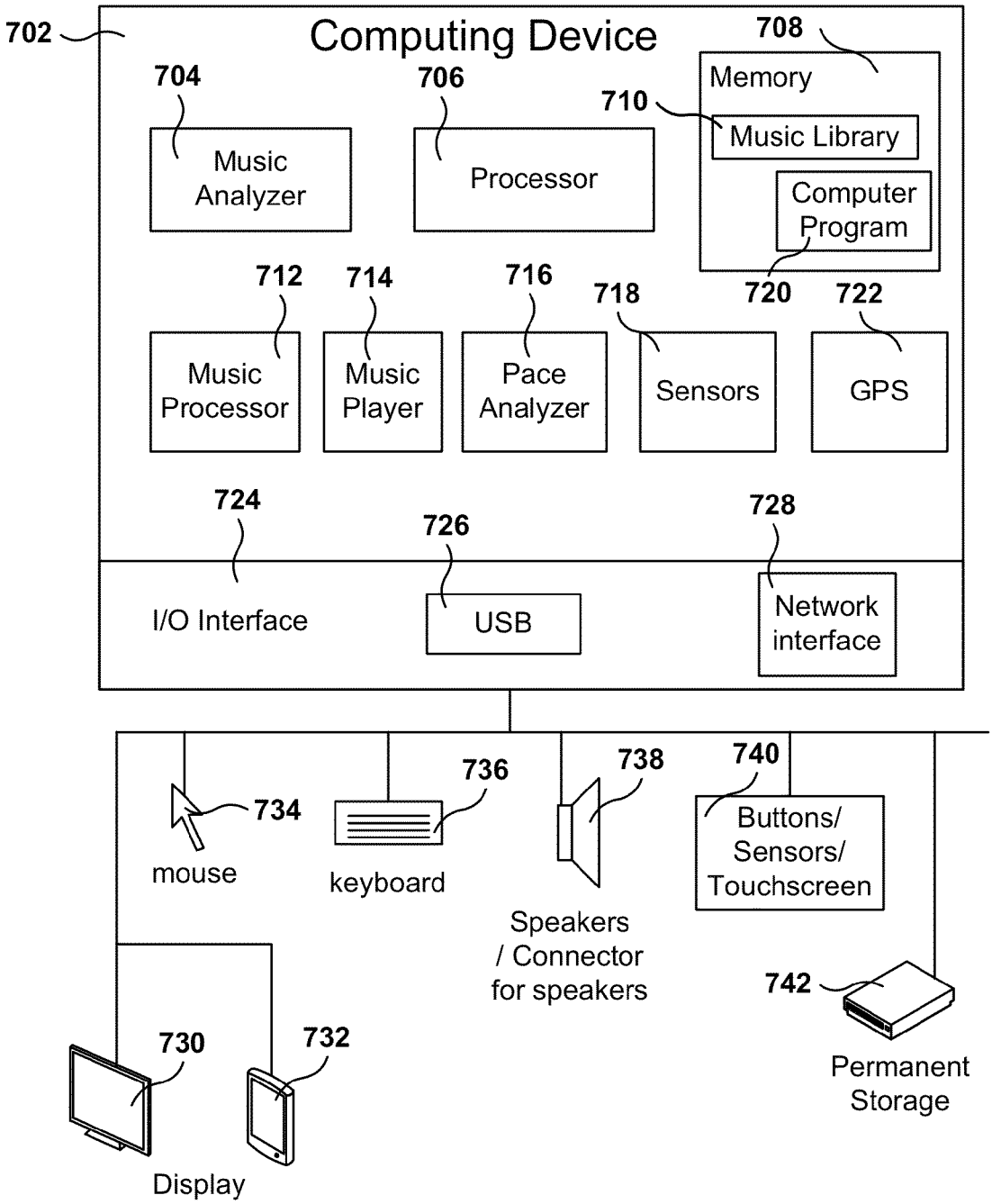
FIG. 7 is an exemplary architecture of a system for implementing embodiments described herein.

FIG. 7 is an exemplary architecture of a system for implementing embodiments described herein. The computing device 702 is an exemplary computing device for implementing embodiments described herein. The computing device 702 includes a processor 706 for executing some of the computer implemented methods described herein, and the memory 708, which holds one or more computer programs 720, a music library 710, and memory utilized by the computer program 720 when been executed. The music library and the computer programs may also be stored in permanent storage 742, or might be stored somewhere on the network and downloaded, as a whole or in parts, as required an on demand.

Computing device 702 further includes music analyzer 704, music processor 712, music player 714, exercise pace analyzer 716, one or more sensors 718, a Global Positioning System (GPS) module 722, and an input/output (I/O) interface 724 for connecting to external devices.

The music analyzer 704 evaluates an audio segment and determines the characteristics of the audio segment. In one embodiment, the characteristics of the audio segment include the prevailing beat or rhythm in the audio segment, also referred to herein as the frequency of the audio segment. The characteristics may also include the duration of the audio segment, song title, genre, distinct segments within the audio segment, information about the song (e.g., author, performer, year introduced to the market, etc.), etc.

The pace analyzer 716 determines the pace, rhythm, or cadence of the exercise based on information received from the sensors 718. The sensors 718 may include one or more of a bicycle crank, a bicycle wheel sensor, sensors in the user's shoes, sensors in the floor or an exercise pad, an accelerometer, an inertial sensor, an exercise machine sensor, an exercise crank, image analysis of the athlete, a GPS sensor 722, etc.

The music processor 712 modifies an audio segment based on the characteristics of the audio segment obtained by music analyzer 704, and the pace of exercise obtained by pace analyzer 716. The modifications may include one or more of adjusting the frequency or duration of the audio segment without modifying the pitch, or modifying the phase of the audio segment by introducing a delay. The music player 714 processes the audio segment produced by music processor 702 and sends the music to one or more speakers. In addition, the music player 714 provides a GUI for enabling the user to select options related to obtaining music for exercising (e.g., see FIG. 4).

The I/O interface 724 includes one or more physical or wireless interfaces to couple the computing device with other physical devices over a physical connection (e.g., USB interface 726) or over a network connection (e.g., network interface 728). The physical devices connected via I/O interface 724 may include one or more of an LCD display 730, a display of a mobile device 732, a mouse 734, a keyboard 736, one or more speakers or connectors for external speakers 738, buttons/sensors/touchscreen 740, and permanent storage 742.

It is noted that the embodiments illustrated in FIG. 7 are exemplary. Other embodiments may utilize additional modules, fewer modules, or combine the functionality of two or more modules into a single module. The embodiments illustrated in FIG. 7 should therefore not be interpreted to be exclusive or limiting, but rather exemplary or illustrative.

Figure 8:
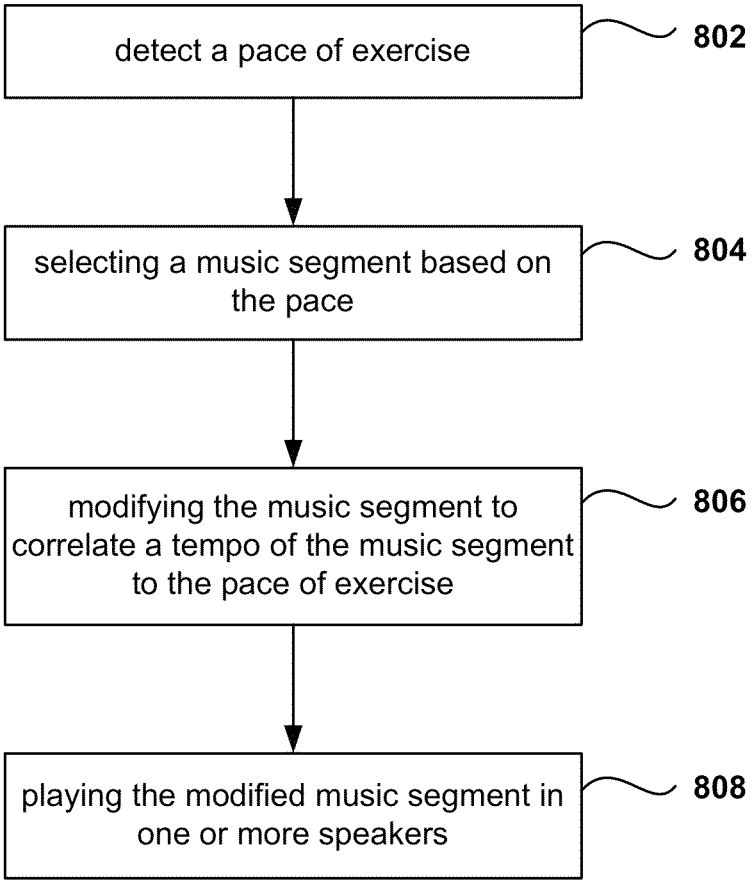
FIG. 8 shows a flowchart illustrating an algorithm for providing music while exercising, in accordance with one embodiment.

FIG. 8 shows a flowchart illustrating an algorithm for providing music while exercising, in accordance with one embodiment. In operation 802, the pace of exercise is detected. In one embodiment, the pace of exercise is detected with a pedometer but other types of sensors may also be used in other embodiments.

From operation 802 the method flows to operation 804, where a music segment is selected based on the pace of the exercise. In one embodiment, a music segment is selected having a frequency or tempo that is equal to, or similar to (e.g., within five percent), the pace of the exercise.

From operation 804, the method flows to operation 806 where the music segment is modified to correlate the tempo of the music segment to the pace of the exercise. For example, the music segment may be modified to increase the duration of the music segment without altering the pitch, in order to have a modified music segment with the same frequency as the exercise frequency. Further, in operation 808 the modified music from operation 806 is played through one or more speakers.

Figure 9:
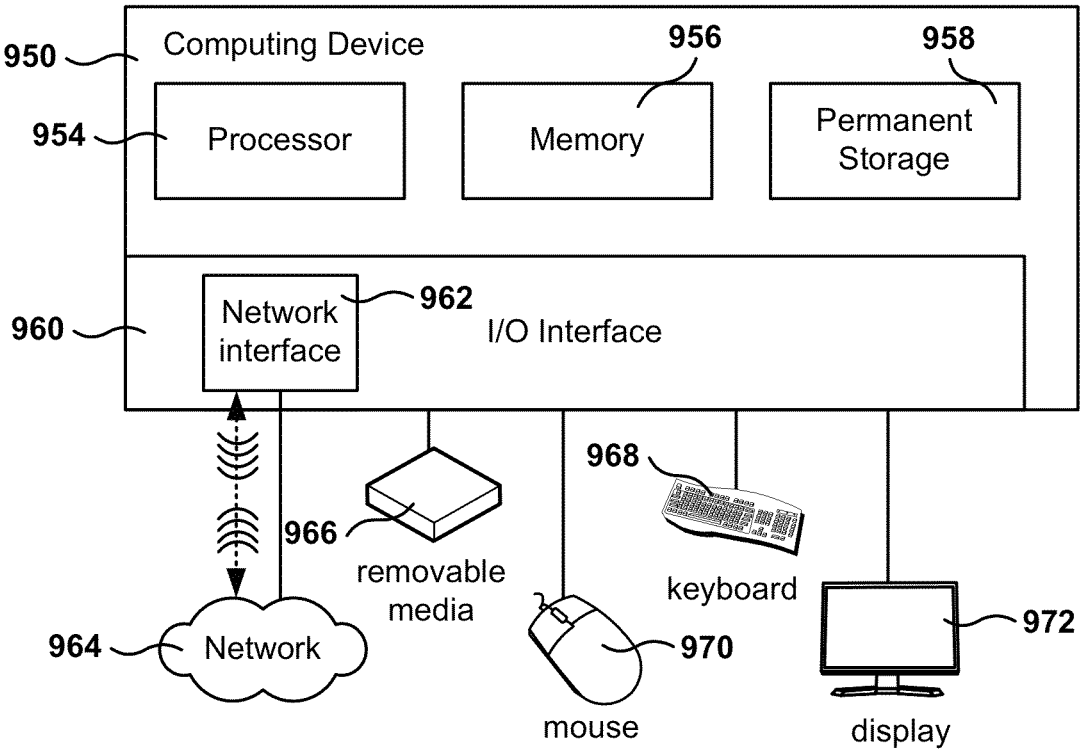
FIG. 9 is a simplified schematic diagram of a computer system for implementing embodiments described herein.

FIG. 9 is a simplified schematic diagram of a computer system for implementing embodiments described herein. It should be appreciated that the methods described herein may be performed with a digital processing system, e.g., a conventional, general-purpose computer system. Special purpose computers, which are designed or programmed to perform only one function, may be used in the alternative. The computing device 950 includes a processor 954, which is coupled through a bus to memory 956, permanent storage 958, and Input/Output (I/O) interface 960.

Permanent storage 958 represents a persistent data storage device e.g., a hard drive or a USB drive, which may be local or remote. Network interface 962 provides connections via network 964, allowing communications (wired or wireless) with other devices. It should be appreciated that processor 954 may be embodied in a general-purpose processor, a special purpose processor, or a specially programmed logic device. Input/Output (I/O) interface 960 provides communication with different peripherals and is connected with processor 954, memory 956, and permanent storage 958, through the bus. Sample peripherals include display 972, keyboard 968, mouse 970, removable media device 966, etc.

Display 972 is configured to display the user interfaces described herein. Keyboard 968, mouse 970, removable media device 966, and other peripherals are coupled to I/O interface 960 in order to exchange information with processor 954. It should be appreciated that data to and from external devices may be communicated through I/O interface 960. Embodiments can also be practiced in distributed computing environments where tasks are performed by remote processing devices that are linked through a wired or a wireless network.

Embodiments can be fabricated as computer readable code on a non-transitory computer readable storage medium. The non-transitory computer readable storage medium holds data which can be read by a computer system. Examples of the non-transitory computer readable storage medium include permanent storage 958, network attached storage (NAS), read-only memory or random-access memory in memory module 956, Compact Discs (CD), Blu-ray™ discs, flash drives, hard drives, magnetic tapes, and other data storage devices. The non-transitory computer readable storage medium may be distributed over a network-coupled computer system so that the computer readable code is stored and executed in a distributed fashion.

Some, or all operations of the method presented herein are executed through a processor, e.g., processor 954 of FIG. 10. Additionally, although the method operations were described in a specific order, it should be understood that some operations may be performed in a different order, when the order of the operations do not affect the expected results. In addition, other operations may be included in the methods presented, and the operations may be performed by different entities in a distributed fashion, as long as the processing of the operations is performed in the desired way.

In addition, at least one operation of some methods performs physical manipulation of physical quantities, and some of the operations described herein are useful machine operations. Embodiments presented herein recite a device or apparatus. The apparatus may be specially constructed for the required purpose or may be a general purpose computer. The apparatus includes a processor capable of executing the program instructions of the computer programs presented herein.

Although the foregoing embodiments have been described with a certain level of detail for purposes of clarity, it is noted that certain changes and modifications can be practiced within the scope of the appended claims. Accordingly, the provided embodiments are to be considered illustrative and not restrictive, not limited by the details presented herein, and may be modified within the scope and equivalents of the appended claims.

What is claimed is:

1. A method for providing music while exercising, the method comprising:

detecting a pace of exercise;

selecting a music segment based on the pace;

modifying the music segment to correlate a tempo of the music segment to the pace of exercise;

introducing a delay in the modified music segment to synchronize the modified music segment to cycles of the pace of exercise; and playing the modified music segment in one or more speakers, wherein operations of the method are executed by a processor.

2. The method as recited in claim 1, wherein modifying the music segment further includes:

changing the tempo of the music segment to match the pace of exercise while maintaining a pitch of the music segment.

3. The method as recited in claim 1, wherein selecting the music segment further includes:

identifying one or more songs in a music library, wherein the one or more songs have tempos within a predetermined threshold of difference with the pace of exercise; and selecting one of the one or more songs.

4. The method as recited in claim 1, wherein selecting the music segment further includes:

to motivate a person exercising to increase the pace, selecting the music segment having a faster tempo than the pace of exercise; and to motivate the person exercising to decrease the pace, selecting the music segment having a slower tempo than the pace of exercise.

5. The method as recited in claim 1, wherein selecting the music segment further includes:

selecting a song having the tempo that is a multiple of the pace or a song having the pace being a multiple of the tempo of the song.

6. The method as recited in claim 1, wherein detecting the pace of exercise further includes:

receiving pace information from one or more of a pedometer, an accelerometer, an inertial sensor, an exercise machine sensor, an exercise crank, a bicycle wheel sensor, a sensor placed in a shoe, or a sensor in an exercise pad.

7. The method as recited in claim 1, wherein selecting the music segment further includes:

selecting a song from a music library.

8. The method as recited in claim 1, wherein selecting the music segment further includes:

sending a request to a music service provider for a song having a tempo within a predetermined threshold of difference with the pace of exercise.

9. The method as recited in claim 1, wherein the exercise includes one of running, biking, rowing, working on an exercise machine, climbing stairs, or swimming.

10. The method as recited in claim 1, wherein operations of the method are performed by a computer program when executed by one or more processors, the computer program being embedded in a non-transitory computer-readable storage medium.

11. A method for providing music while exercising, the method comprising:

detecting a pace of exercise for each section of an exercise program;

for each section, selecting a music segment based on the pace of exercise of the section;

modifying the music segment to correlate a tempo of the music segment to the pace of exercise of the section;

adjusting a volume of the modified music segment based on a difference between the pace of exercise and the tempo; and playing the modified music segment in one or more speakers, wherein operations of the method are executed by a processor.

12. The method as recited in claim 11, wherein modifying the music segment further includes:

changing the tempo of the music segment to match the pace of exercise while maintaining a pitch of the music segment.

13. The method as recited in claim 11, wherein modifying the music segment further includes:

after modifying the music segment, introducing a delay in the modified music segment to synchronize the modified music segment to cycles of the pace of exercise.

14. The method as recited in claim 11, further including:

detecting a heart rate of a person exercising; and providing a music segment based on the heart rate.

15. A system for providing music while exercising, the system comprising:

a sensor operable to detect a pace of exercise;

a processor, wherein the processor is operable to:

select a music segment based on the pace;

modify the music segment to correlate a tempo of the music segment to the pace of exercise; and introduce a delay in the modified music segment to synchronize the modified music segment to cycles of the pace of exercise; and one or more speakers operable to play the modified music segment.

16. The system of claim 15, further including a graphical user interface (GUI), the GUI including:

an option to select a source for the music segment;

an option to select an exercise program; and an option to select a desired pace of exercise.

17. The system of claim 15, further including:

a heart rate monitor operable to detect a heart rate of a person exercising.

18. The system of claim 15, wherein modifying the music segment further includes:

changing the tempo of the music segment to match the pace of exercise while maintaining a pitch of the music segment.

19. The method as recited in claim 1, wherein introducing the delay further includes:

introducing the delay in increments during a plurality of cycles of the pace of exercise.

* * * * *